US006547599B2

(12) United States Patent
Kinsey et al.

(10) Patent No.: US 6,547,599 B2
(45) **Date of Patent: *Apr. 15, 2003**

(54) TRUCK ELECTRICAL SOCKET WITH ENHANCED CONNECTION CAPACITY

(75) Inventors: Gregory W. Kinsey, Culver City, CA (US); Patrick E. Lewis, Tustin, CA (US)

(73) Assignee: R. A. Phillips Industries, Inc., City of Commerce, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 85 days.

(21) Appl. No.: 09/433,845

(22) Filed: Nov. 4, 1999

(65) Prior Publication Data

US 2002/0111073 A1 Aug. 15, 2002

(51) Int. Cl.[7] ..... H01R 13/68
(52) U.S. Cl. ..... 439/621
(58) Field of Search ..... 439/621, 651, 439/655, 34, 35, 620, 650

(56) References Cited

U.S. PATENT DOCUMENTS 1,830,790 A * 10/1931 Greaves et al. ..... 439/651
3,187,125 A * 6/1965 Bergauer ..... 439/651
5,626,479 A * 5/1997 Hughes ..... 439/651
6,007,346 A * 12/1999 Gutierrez ..... 439/35

* cited by examiner

*Primary Examiner*—P. Austin Bradley
*Assistant Examiner*—Alexander Gilman
(74) *Attorney, Agent, or Firm*—Christie, Parker & Hale, LLP

(57) ABSTRACT

An electric socket assembly is provided having a socket sleeve, an insert disc, a socket cap and a plurality of plug extenders. The insert disc carries a common pin and a plurality of non-common pins on its front face and service connection studs on its rear face. Each service connection stud is electrically connected to a respective pin. A socket cap having a plurality of pockets is positioned over the service connection studs such that each service connection stud extends through an opening in the respective pocket of the cap. A plug extender is positioned in each of the pockets of the cap such that the service connection stud extending through the opening in the pocket also extends through an opening in the plug extender. The plug extender includes plural service connection terminals in conductive relation to the service connection stud to enhance the connection capacity of the socket assembly. The plug extender is secured in the pocket using a fastener which can be a component of one of the service connection terminals.

20 Claims, 6 Drawing Sheets

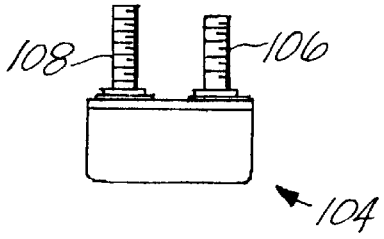
Fig. 12
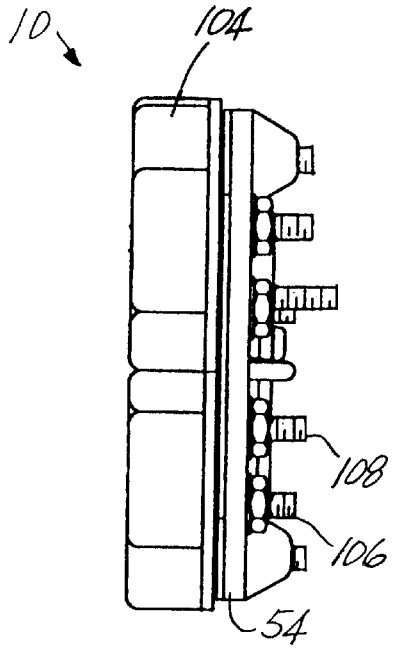
Fig. 13
Fig. 14
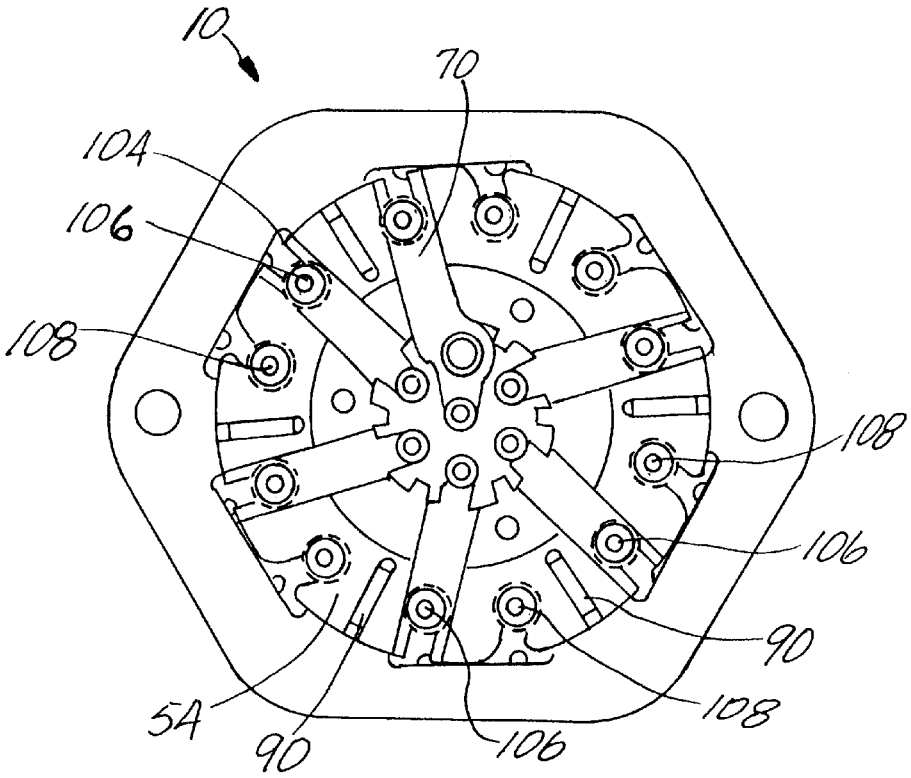

TRUCK ELECTRICAL SOCKET WITH ENHANCED CONNECTION CAPACITY

FIELD OF THE INVENTION

The present invention relates to electric sockets and more particularly to a truck electrical socket having enhanced connection capacity.

BACKGROUND OF THE INVENTION

Heavy duty trucks are composed of a tractor and one or more trailers coupled in series to the rear portion of the tractor. The trailers are equipped with various electrical devices which are powered from the tractor. To establish an electrical connection between the tractor and the trailer, an electrical cable is connected between the back of the tractor and the front of the trailer. This connection is also made between trailers if the truck rig includes a plurality of trailers.

The electrical cable has six or seven (usually seven) conductors and suitable plugs at each end of the cable. The plugs are connectible to cooperating six or seven contact sockets mounted, respectively, in the rear wall of the tractor cab and the front end of the trailer. The basic geometries of those sockets and plugs are the subject of applicable SAE (Society of Automotive Engineers) standards, specifically SAE standard J560, a copy of which is present in the prosecution history (official record) of this patent. Standardizing the geometries of the sockets and plugs ensures that any trailer can be electrically connected to any tractor using any cable assembly. SAE standard J560 is incorporated hereinto by reference.

FIG. 1 shows a known socket assembly 10. The socket assembly 10 can be installed on the front of the trailer facing the back of the tractor or on the back of the tractor facing the front of the trailer. Socket assembly 10 includes a front face 12 which carries seven male pins in an array per SAE standard J560. One of the pins is a common terminal. The seven pins extend into the inside of the sleeve 18 and form the socket receptacle into which the end of the electrical cable connecting the tractor and the trailer is plugged. The socket receptacle is closeable by a spring loaded door 20.

The rear face 14 of the socket assembly 10 carries a service connection stud 22 for each non-common terminal disposed on the front face 12. Electrical conductors from the circuits of electrical and/or electronic equipment are connected to the service connection studs 22 of the socket assembly 10. Traditionally, loop lugs or spade lugs have been used to connect the electrical conductors to the service connection studs 22 of the socket assembly 10. This connection method has several disadvantages.

With increasingly complicated electrical systems, there is an increasing need for additional service connection points at a rear of a socket assembly 10. This is especially true for circuits designed with parallel legs that have a plurality of live ends that need to be installed on the same terminal. In the traditional socket assembly 10, this type of connection requires the loop lugs to be stacked on top of each other on a single service connection stud 22. This process is inefficient because the wires of the electrical conductors are stiff and hard to maneuver. There is also a limited space within which to fit all of the loop lugs. These restrictions make assembly difficult and time consuming.

Accordingly, it would be desirable to have an improved socket assembly with an enhanced capacity to accept electrical connectors.

It would be further desirable to create a connection system that is uncomplicated and efficient.

SUMMARY OF THE INVENTION

The present invention significantly enhances a socket's capacity to accept electrical connectors, allowing up to a maximum of twenty-eight connectors in a presently preferred form of the invention. Additionally, the electrical connectors can be configured to simply plug into the electrical conductors, simplifying the connection process and minimizing the assembly time required to make the connection.

The present invention provides an electric socket assembly having a socket sleeve, an insert disc, a socket cap and a plurality of plug extenders. The insert disc carries a common pin and a plurality of non-common pins on its front face and service connection studs on its rear face. Each service connection stud is electrically connected to a respective pin. A socket cap having a plurality of pockets is positioned over the service connection studs such that each service connection stud extends through an opening in the respective pocket of the cap. A plug extender is positioned in each of the pockets of the cap such that the service connection stud extending through the opening in the pocket also extends through an opening in the plug extender. The plug extender includes additional service connection studs to enhance the connection capacity of the socket assembly. The plug extender is secured in the pocket using a fastener.

In another embodiment of the present invention, the invention is implemented in an electric socket assembly for truck tractors and trailers. The electric socket assembly includes a socket sleeve open at one end and having mounted therein a common connection pin and plural non-common connection pins. The connection pins and the sleeve at and adjacent its open end define a receptacle which is matable with a plug at an end of a tractor-trailer or trailer-trailer interconnection cable. The receptacle and the plug conform to a standard pertinent to electrical interconnections between truck tractors and trailers. The sleeve has features which adapt it for mounting directly in an opening into a truck tractor or trailer with its open end adjacent an outer surface of the tractor or trailer. In that context, the improvement is that in which at least some of the connection pins at ends thereof opposite from the sleeve open end have plural service connection terminals conductively connected to them.

In an alternative embodiment of the present invention, the socket assembly may include circuit breakers. Each circuit breaker has a fused terminal and a non-fused terminal. When circuit breakers are used, the non-fused terminal of each circuit breaker is electrically connected to a non-common pin. The fused terminal of the circuit breaker is extended through an opening in the socket cap and through an opening in the plug extender. The fused terminal becomes the service connection stud for connecting the electrical conductors from the circuits of electronic equipment.

DESCRIPTION OF THE DRAWINGS

Other features and advantages of the invention will become apparent upon reading the following detailed description of the invention and upon reference to the drawings in which:

FIG. 12 is a side view of a circuit breaker of an embodiment of the present invention;

FIG. 13 is a side view of the insert disc of an embodiment of the socket assembly of the present invention having circuit breakers; and FIG. 14 is a top plan view of the insert disc of an embodiment of the socket assembly of the present invention having circuit breakers.

DETAILED DESCRIPTION OF THE INVENTION

Figure 4:
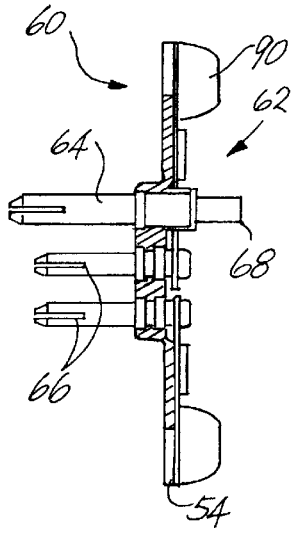
FIG. 4 is a side view of the insert disc of an embodiment of the socket assembly of the present invention.
Figure 2:
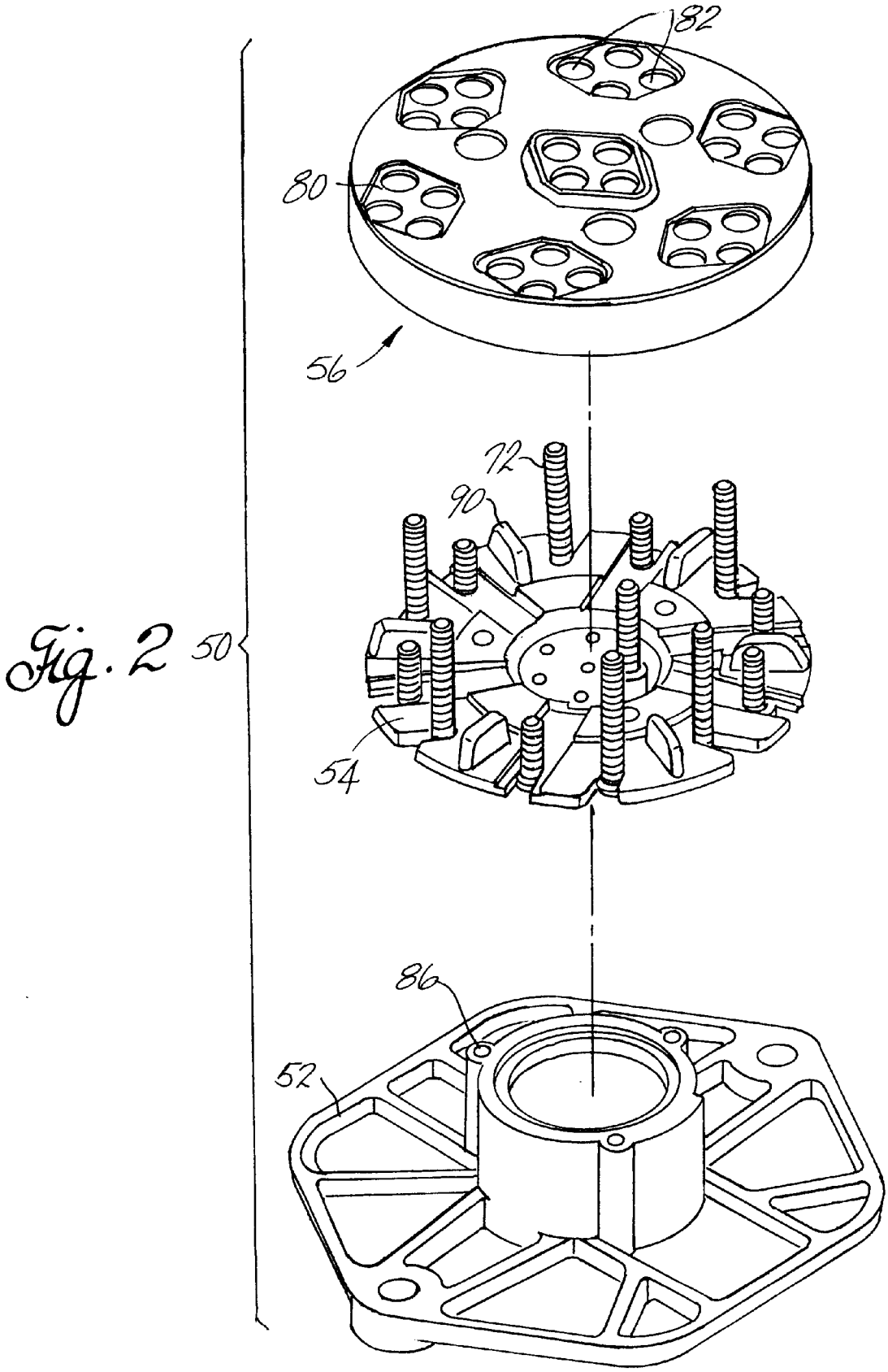
FIG. 2 is an exploded view of an embodiment of the socket assembly of the present invention.
Figure 5:
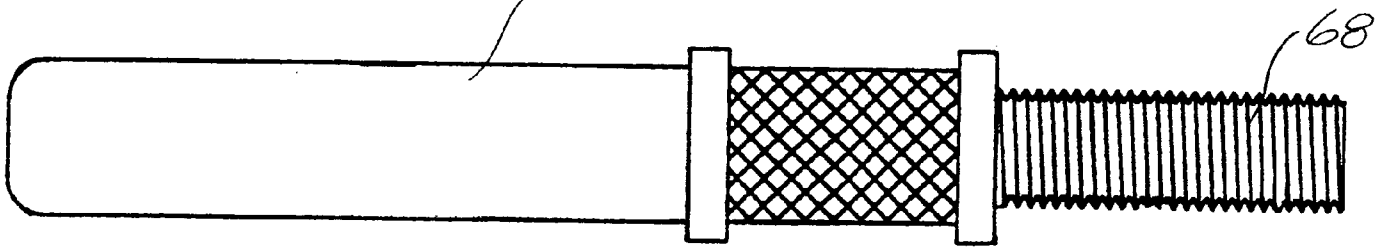
FIG. 5 is a side view of the ground pin of the socket assembly of the present invention.
Figure 6:
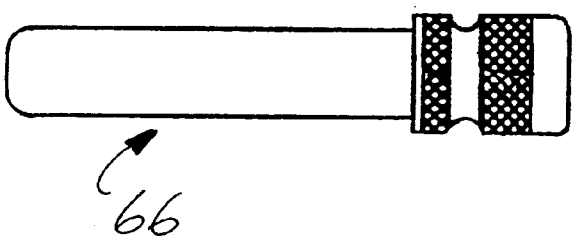
FIG. 6 is a side view of a non-common pin of the socket assembly of the present invention.

As shown in FIG. 2, the socket assembly 50 of the present invention includes a socket sleeve 52, an insert disc 54, a socket cap 56 and at least one plug extender 58. As best shown in FIG. 4, the insert disc 54 has a front face 60 and a rear face 62. The front face 60 of the insert disc 54 includes a common pin 64, also known as a ground pin, and a plurality of non-common pins 66. In the preferred embodiment of the present invention, there are six non-common pins and one common pin arranged in the configuration shown in FIG. 3, with the common pin located at the top center. The common and non-common pins are sized and positioned in conformity with SAE standard J560. Depending on the application, the pins may be slotted, as shown in FIG. 4, or solid as shown in FIG. 6. The common pin 64 is preferably fixedly attached to a ground stud 68 as shown in FIG. 5 and molded into the insert disc 54 such that the common pin 64 is disposed on the front face 60 of the insert disc 54 and the ground stud 68 is disposed on the rear face 62 of the insert disc 54.

Figure 1:
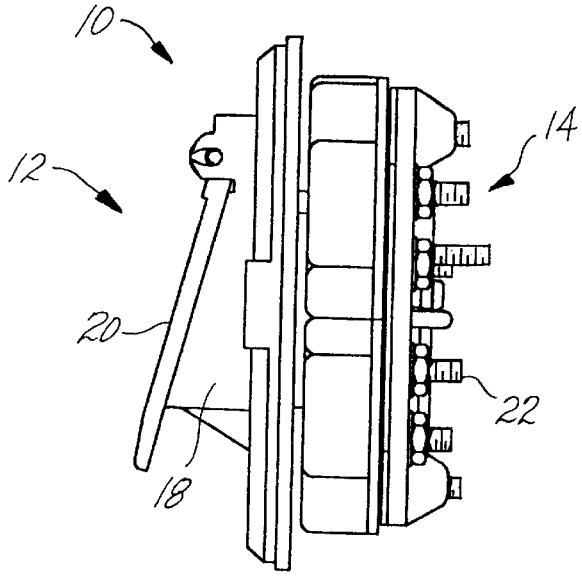
Fig. 1 PRIOR ART
FIG. 1 is a side view of a known socket assembly.
Figure 3:
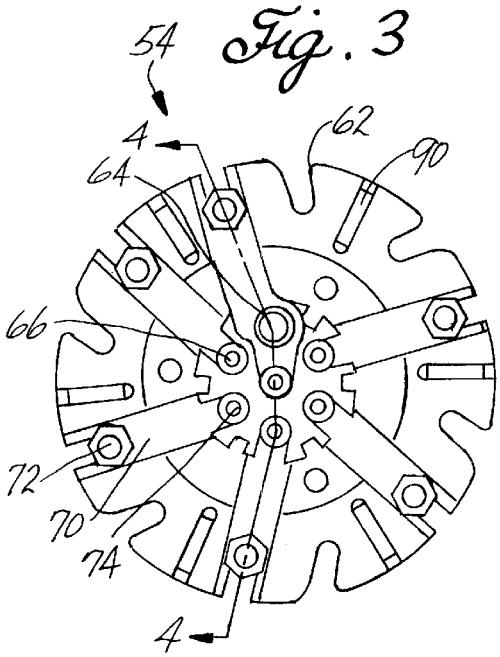
FIG. 3 is a top plan view of the insert disc of an embodiment of the socket assembly of the present invention.

As shown in FIG. 3, on the rear face 62 of the insert disc 54, conductive strips 70 are provided for electrically connecting the non-common pins 66 to the service connection studs 72. The electrical connection is preferably made by connecting one end of a copper strip to a non-common pin 66 using a screw fastener 74. The other end of the conductive strip is connected to a service connection stud 72 located near the circumference of the insert disc 54.

Figure 7:
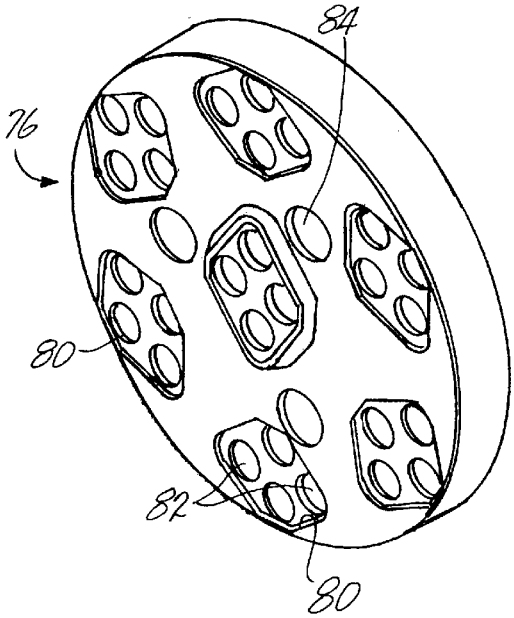
FIG. 7 is a perspective view of the outer surface of the socket cap of the present invention.
Figure 8:
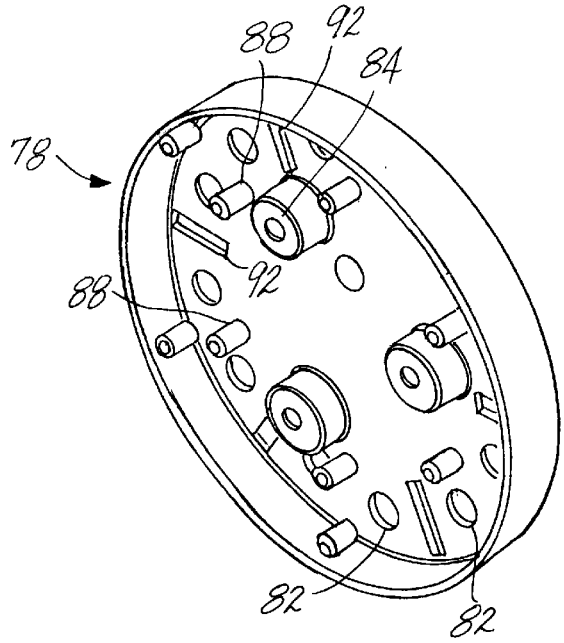
FIG. 8 is a perspective view of the inner surface of the socket cap of the present invention.

The socket cap 56 of the present invention is shown in FIGS. 7 and 8. The socket cap 56 includes an outer surface 76 and an inner surface 78. The outer surface 76 contains a plurality of recessed pockets 80. Each pocket 80 is dimensioned to receive a plug extender 58. As shown in FIG. 2, the socket cap 56 is positioned over the service connection studs 72 such that each service connection stud 72 extends through a respective pocket opening 82 of the socket cap 56. For the reasons described below, there are two openings 82 in the socket cap in association with each plug extender pocket 80.

The socket cap 56 can be assembled to the socket sleeve 52 by threading fasteners (not shown) through the fastening apertures 84 in the socket cap 56 and into threaded bores 86 (see FIG. 2) in the socket sleeve 52. The inner surface 78 of the socket cap 56 includes support bars 88 to support the structural integrity of the socket cap 56. Additionally, in further structural support of the insert cap 56, support ribs 90 located on the insert disc 54 fit into rib recesses 92 on the socket cap 56. The insert cap has only one mounted angular relationship to the insert disc.

Figure 9:
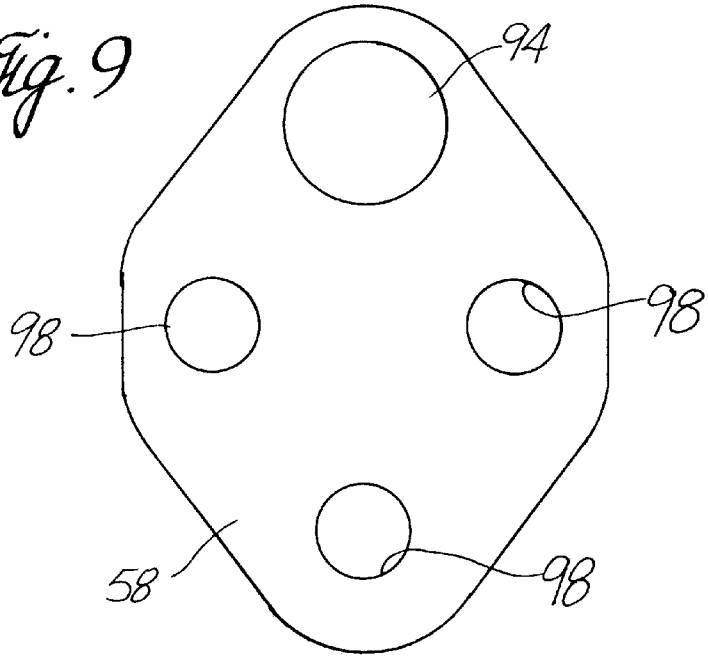
FIG. 9 is a top plan view of the plug extender of the preferred embodiment of the socket assembly of the present invention.
Figure 10:
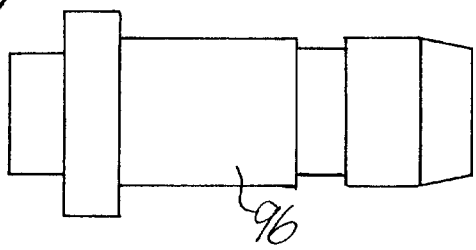
FIG. 10 is a side view of one of the additional service connection studs of the present invention.
Figure 11:
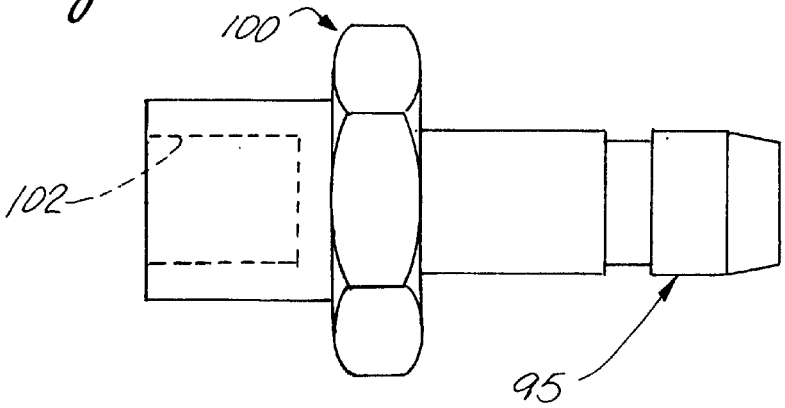
FIG. 11 is a side view of a preferred fastener that is used to secure the plug extender in the pocket.

As shown in FIGS. 2 and 9, the plug extender 58 has an opening 94 dimensioned to receive the service connection stud 72 extending through one of the two pocket openings 82 formed through the insert cap in each plug extender mounting pocket. The plug extender 58 carries service connection terminals 95 and 96 thereon. A hex pin 100 (shown in FIG. 11) can be used to secure the plug extender 58 to the pocket 80. The hex pin 100 has a tapped bore 102 at a first side dimensioned to receive the service connection stud 72. The hex pin 100 is threadable onto the service connection stud 72, securing the plug extender 58 to the pocket 80. At its end opposite from the bore 102, the hex pin defines an additional service connection terminal 95. The hex pin establishes a conductive connection to the plug extender. In the preferred embodiment, each further service connection terminal 96 (shown in FIG. 10) is swaged into an aperture 98 in the plug extender 58. Each plug extender 58 preferably has up to three further additional service connection terminals 96.

In this description, the term "service connection stud" is used with reference to an actual or potential electrical connection point carried by the insert disc. The term "service connection terminal" is used with reference to an electrical connection point which is accessible at the outer surface 76 of the socket cap.

In an alternative embodiment of the present invention, circuit breakers 104, as shown in FIG. 12, are used to protect the electrical equipment which receives power via the socket assembly from damage due to excess current. Each circuit breaker 104 includes a fused terminal 108 and a non-fused terminal 106. In the preferred embodiment, the non-fused terminal 106 is shorter than the fused terminal 108. The circuit breaker 104 is incorporated into the socket assembly 10 of the present invention as shown in FIGS. 13 and 14. Specifically, the conductive strips 70 electrically connect the non-common pins 66 to the non-fused terminal 106 of the circuit breaker 104. The socket cap 56 is positioned over the circuit breaker terminals 106, 108 such that the fused terminal 108 extends through a corresponding pocket opening 82 of the socket cap 56 where it can have a plug extender 58 connected to it by a hex pin 100. The non-fused terminal 106 preferably has a height shorter than the height of the socket cap 56, such that it cannot extend through the other pocket opening 82 of the corresponding pocket opening in the socket cap 56. The plug extender 58 has an opening 94 dimensioned to receive the fused terminal 108 extending through the pocket opening 82. In this embodiment, the fused terminal becomes an extended service connection terminal that forms an electrical connection with the electrical conductors of the electronic equipment of the truck. The plug extender 58 carries additional service connection terminals 96 thereon to enhance the connection capacity of the socket assembly.

It will be seen from FIGS. 7 and 9 that each plug extender 58 has two possible ways in which it can fit into its recessed positioning pocket in face 76 of the insert cap. One way locates hole 94 over the end of a corresponding conduction strip 70, and the other way locates hole 94 over the other opening 82 to that pocket.

The circuit breaker terminals 106, 108 can be color coded to distinguish between the fused and non-fused terminals. In one embodiment of the present invention, the non-fused terminal can be copper plated to clarify its connection to the copper plated conductive strips. The fused terminal can be zinc plated to distinguish it from the copper plated fused terminal. The electrical conductors of the truck equipment are connected to the zinc plated fused terminal, as well as to the additional service connection studs provided on the plug extender.

In the preferred embodiment of the present invention, all of the pockets 80 have the same dimension and all of the plug extenders 58 have the same dimension. Creating identical plug extenders for all pockets simplifies manufacturing. However, the plug extenders can vary in size and shape. For instance, the plug extender for the center of the socket cap can be larger to accommodate more service connection studs because there is more space in the middle of the socket cap than on the circumference. The increase in the size of the plug extender, of course, will require a corresponding increase in the size of the center pocket.

While the invention is disclosed in conjunction with specific embodiments thereof, it is to be evident that many alternatives, modifications, and variations will be apparent to those skilled in the art in light of the foregoing description. Accordingly, it is intended to embrace all such alternatives, modifications and variations as falling within the spirit and broad scope of the appended claims.

What is claimed is:

1. An electric socket assembly for truck tractors and trailers comprising:

an insert disc having a front face and a rear face;

a common pin and a plurality of non-common pins carried on the front face of the insert disc;

a plurality of service connection studs carried on the rear face of the insert disc corresponding to each non-common pin on the front face, each service connection stud being electrically connected to the respective non-common pin;

a ground stud disposed on the rear face of the insert disc and electrically connected to the common pin disposed on the front face;

a cap having an inner surface and an outer surface, the outer surface of the cap having a plurality of pockets, each pocket corresponding with one of the service connection studs, each service connection stud extending through an opening in the respective pocket of the cap;

a plurality of conductive plug extenders, each plug extender having an opening dimensioned to receive a service connection stud, each plug extender positioned in a respective one of the pockets such that the service connection stud extending through the opening in the pocket also extends through the opening in the plug extender;

a service connection terminal connected to the connection stud in the opening of each plug extender in conductive engagement with the plug extender; and at least one additional service connection terminal conductively carried by each of the plug extenders.

2. The electric socket assembly of claim 1 wherein the additional service connection terminal on the plug extender comprises a pin swaged to the plug extender.

3. The electric socket assembly of claim 1 wherein the plug extender accommodates three additional service connection terminals.

4. The electric socket assembly of claim 1 further comprising a sleeve wherein the common and non-common pins extend into the sleeve forming a socket.

5. The electric socket assembly of claim 4 wherein the socket is closeable by a spring-loaded door.

6. The electric socket assembly of claim 1 wherein the cap further comprises a center pocket corresponding with the ground stud and a center plug extender positioned in the center pocket, the center plug extender having an opening dimensioned to receive the ground stud, the ground stud extending through an opening in the center pocket and the opening in the plug extender.

7. The electric socket assembly of claim 6 wherein the center plug extender accommodates more than three service connection terminals.

8. An electric socket assembly comprising:

an insert disc having a front face and a rear face;

a common pin and a plurality of non-common pins carried on the front face of the insert disc;

a plurality of circuit breakers, each circuit breaker having a fused terminal and a non-fused terminal, each non-fused terminal electrically connected to a respective non-common pin, each fused terminal serving as a non-common service connection stud;

a ground service connection stud disposed on the rear face of the insert disc and electrically connected to the common pin disposed on the front face;

a cap having an inner surface and an outer surface, the outer surface of the cap having a plurality of pockets, each pocket corresponding with one of the service connection studs, each service connection stud extending through an opening in the respective pocket of the cap;

a plurality of conductive plug extenders, each plug extender having an opening dimensioned to receive a service connection stud, each plug extender positioned in a respective one of the pockets such that the service connection stud extending through the opening in the pocket also extends through the opening in the plug extender;

a service connection terminal connected to the connection stud in the opening of each plug extender in conductive engagement with the plug extender; and at least one additional service connection terminal located on each of the plug extenders.

9. The electric socket assembly of claim 8 wherein the non-fused circuit breaker terminal preferably has a height shorter than a height of the fused terminal such that the non-fused terminal cannot extend through an opening of the pocket.

10. The electric socket assembly of claim 8 wherein the additional service connection terminal on the plug extender comprises a pin swaged to the plug extender.

11. The electric socket assembly of claim 8 further comprising a pin attached to the service connection stud to secure the plug extender in the pocket.

12. The electric socket assembly of claim 8 wherein the plug extender conductively carries at least three service connection terminals.

13. The electric socket assembly of claim 8 further comprising a sleeve wherein the common and non-common pins extend into the sleeve forming a socket.

14. The electric socket assembly of claim 13 wherein the socket is closeable by a spring-loaded door.

15. The electric socket assembly of claim 8 wherein the cap further comprises a center pocket corresponding with the ground service connection stud and a center plug extender positioned in the center pocket, the center plug extender having an opening dimensioned to receive the ground stud, the ground stud extending through an opening in the center pocket and the opening in the plug extender.

16. The electric socket assembly of claim 15 wherein the center plug extender conductively carries at least four additional service connection terminals.

17. In an electric socket assembly for truck tractors and trailers which includes a socket sleeve open at one end and having mounted therein a common connection pin and plural non-common connection pins, the connection pins and the sleeve at and adjacent its open end defining a receptacle matable with a plug at an end of a tractor-trailer or trailer—trailer interconnection cable, the receptacle and the plug conforming to a standard pertinent to electrical interconnections between truck tractors and trailer, the sleeve having features adapting it for mounting directly in an opening into a truck tractor or trailer with its open end adjacent an outer surface of the tractor or trailer, the improvement in which at least some of the connection pins at their ends thereof opposite from the sleeve open end have plural service connection terminals conductively connected to them.

18. An electric socket assembly according to claim 17 including a circuit breaker in series between at least one of the connection pins and the service connection terminals connected to the pin.

19. A socket assembly according to claim 17 in which each connection pin has a service connection terminal disposed coaxially thereof.

20. A socket assembly according to claim 17 in which the service connection terminals associated with each connection pin are disposed in spaced physical and electrically parallel relation to each other.

* * * * *

UNITED STATES PATENT AND TRADEMARK OFFICE

CERTIFICATE OF CORRECTION

PATENT NO. : 6,547,599 B2
DATED : April 15, 2003
INVENTOR(S) : Kinsey et al.

It is certified that error appears in the above-identified patent and that said Letters Patent is hereby corrected as shown below:

Title page,
Item [56], References Cited, U.S. PATENT DOCUMENTS, replace "1,830,790A with -- 1,830,790A 11/1931 --

Column 7,
Line 11, delete claim 17 and replace with the following:

-- 17. In an electric socket assembly for truck tractors and trailers which includes a socket sleeve open at one end and having mounted therein a common connection pin and plural non-common connection pins, the connection pins and the sleeve at and adjacent its open end defining a receptacle matable with a plug at an end of a tractor-trailer or trailer-trailer interconnection cable, the receptacle and the plug conforming to a standard pertinent to electrical interconnections between truck tractors and trailer, the sleeve having features adapting it for mounting directly in an opening into a truck tractor or trailer with its open end adjacent an outer surface of the tractor or trailer, the improvement in which at least some of the connection pins at ends thereof opposite from the sleeve open end have plural service connection terminals conductively connected to them.--

Signed and Sealed this

Eighth Day of June, 2004

JON W. DUDAS
*Acting Director of the United States Patent and Trademark Office*